US007837604B1

(12) United States Patent
Hsu

(10) Patent No.: US 7,837,604 B1
(45) Date of Patent: Nov. 23, 2010

(54) TRAINING MACHINE

(75) Inventor: Ching-Lu Hsu, Taipei County (TW)

(73) Assignee: Gee Hoo Fztec Corp., Taipei County (TW)

( * ) Notice: Subject to any disclaimer, the term of this patent is extended or adjusted under 35 U.S.C. 154(b) by 0 days.

(21) Appl. No.: 12/548,305

(22) Filed: Aug. 26, 2009

(51) Int. Cl.
*A63B 21/00* (2006.01)
*A63B 22/06* (2006.01)
*A63B 69/06* (2006.01)

(52) U.S. Cl. ..... 482/137; 482/57; 482/72

(58) Field of Classification Search ..... 482/72, 482/73, 95, 96, 130, 132, 133, 135, 142, 482/57, 137; 297/172
See application file for complete search history.

(56) References Cited

U.S. PATENT DOCUMENTS 1,577,809 A * 3/1926 Randall ..... 482/72
3,130,968 A * 4/1964 De Feen ..... 482/132
3,912,264 A * 10/1975 Busse et al. ..... 482/72
4,563,000 A * 1/1986 Gall ..... 482/72
4,768,775 A * 9/1988 Marshall ..... 482/73
5,029,848 A * 7/1991 Sleamaker ..... 482/96
5,580,340 A * 12/1996 Yu ..... 482/96
6,340,342 B1 * 1/2002 Lee ..... 482/142
2008/0064577 A1 * 3/2008 Pederson et al. ..... 482/140

* cited by examiner

*Primary Examiner*—Loan Thanh
*Assistant Examiner*—Allana Lewin
(74) *Attorney, Agent, or Firm*—Apex Juris, pllc; Tracy M Heims

(57) ABSTRACT

A training machine includes a seat assembly, a loading device, and a positioning device. The seat assembly includes a transverse main tube fitted to an elongated rail of the loading device. The seat assembly is provided with rollers to help the seat assembly having a smooth movement on the rail. The positioning device is able to fix the seat assembly to any desired position of the rail of the loading device. The present invention further provides a swinging device with two handles to be operated by users for arm training.

5 Claims, 6 Drawing Sheets

TRAINING MACHINE

BACKGROUND OF THE INVENTION

1. Field of the Invention

The present invention relates generally to a form of indoor exercise or rehabilitation apparatus, and more particularly to a stepping-style training machine.

2. Description of the Related Art

Typically, conventional indoor training machines are huge. For reducing cost and consideration for safety, the training machines are disassembled for delivery. A drawback of that is, too many separate elements will make it inconvenient for assembling and disassembling. To avoid aforesaid drawback, some disassemble the training machine into fewer parts that may reduce the cost of delivery and make assembling and disassembling easier.

For a stepping-style training machine, it may be generalized into three main parts, which include a seat, a rail, and a loading mechanism. However, the rail is usually fixed with the seat which makes it disadvantageous for packing. In order to take advantage of space while packing, a pipe on a bottom of the loading mechanism is usually not long that the rail only has a limited part inserted into the pipe of the loading mechanism. Therefore, the seat has an insufficient distance to shift to a desired position for some users to exercise with comfort. Besides, the limitation of the pipe also causes an unsmooth movement of the rail, which also makes it inconvenient for assembling and adjusting.

SUMMARY OF THE INVENTION

The primary objective of the present invention is to provide a training machine, which may reduce the size of packing and provides a fast way of assembling and disassembling the machine. Furthermore, the seat may be moved smoothly with relation to the loading mechanism.

According to the objective of the present invention, a training machine includes a seat assembly, a loading device, and a positioning device. The seat assembly includes a base having a transverse main tube and a post connected to the main tube, a seat fixed to a top of the post, and a plurality of rollers pivoted on opposite sides of the base respectively. The loading device includes an elongated rail connected to the main tube of the base for the seat assembly to reciprocate, and a loading mechanism provided at an end of the rail having an input terminal for operation. The positioning device is able to fix the seat assembly to the rail of the loading device.

DETAILED DESCRIPTION OF THE INVENTION

Figure 1:
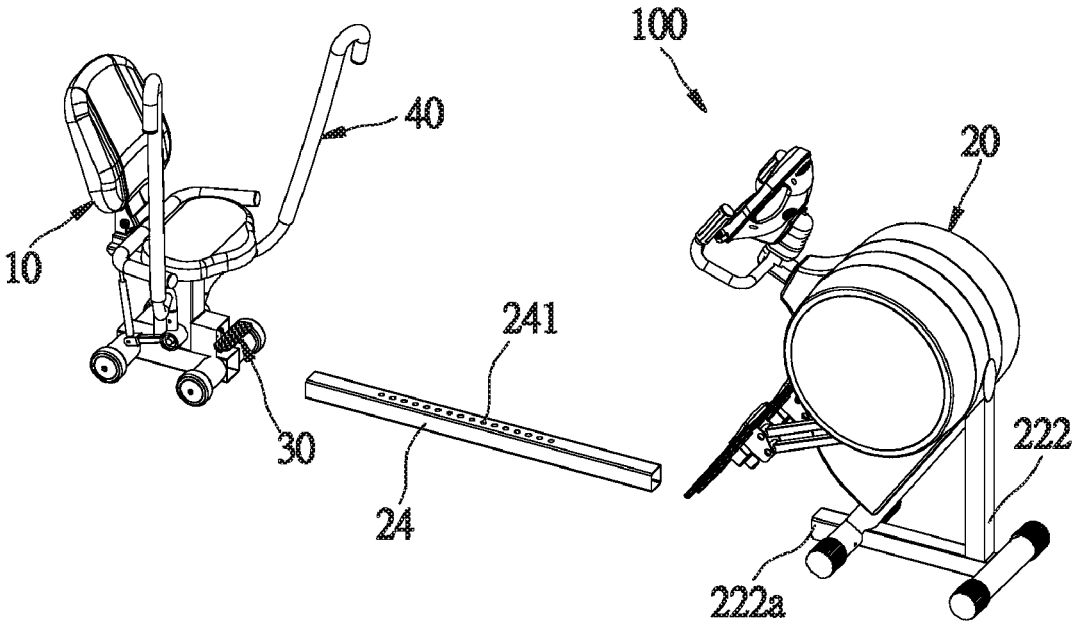
FIG. 1 is an exploded view of a preferred embodiment of the present invention.
Figure 2:
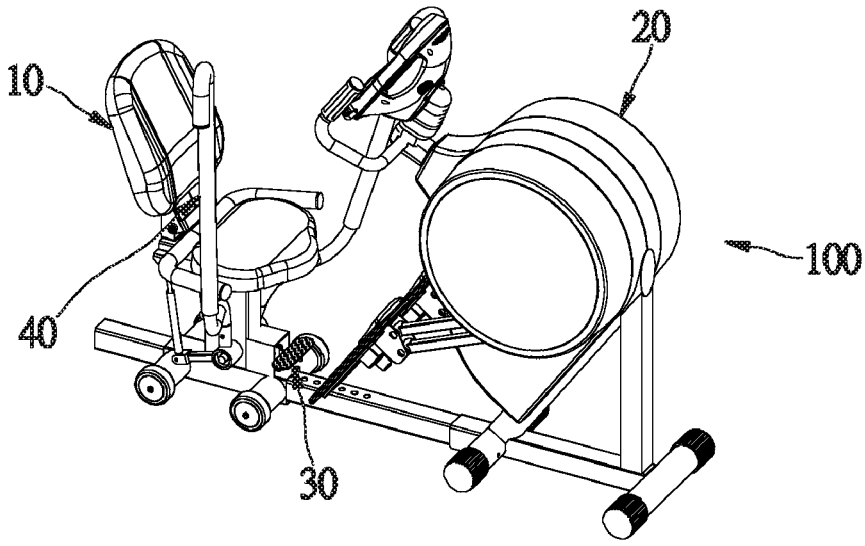
FIG. 2 is a perspective view of the preferred embodiment of the present invention.

As shown in FIG. 1 and FIG. 2, a training machine 100 of the first preferred embodiment of the present invention includes a seat assembly 10, a loading device 20, a positioning device 30, and a swinging device 40.

Figure 3:
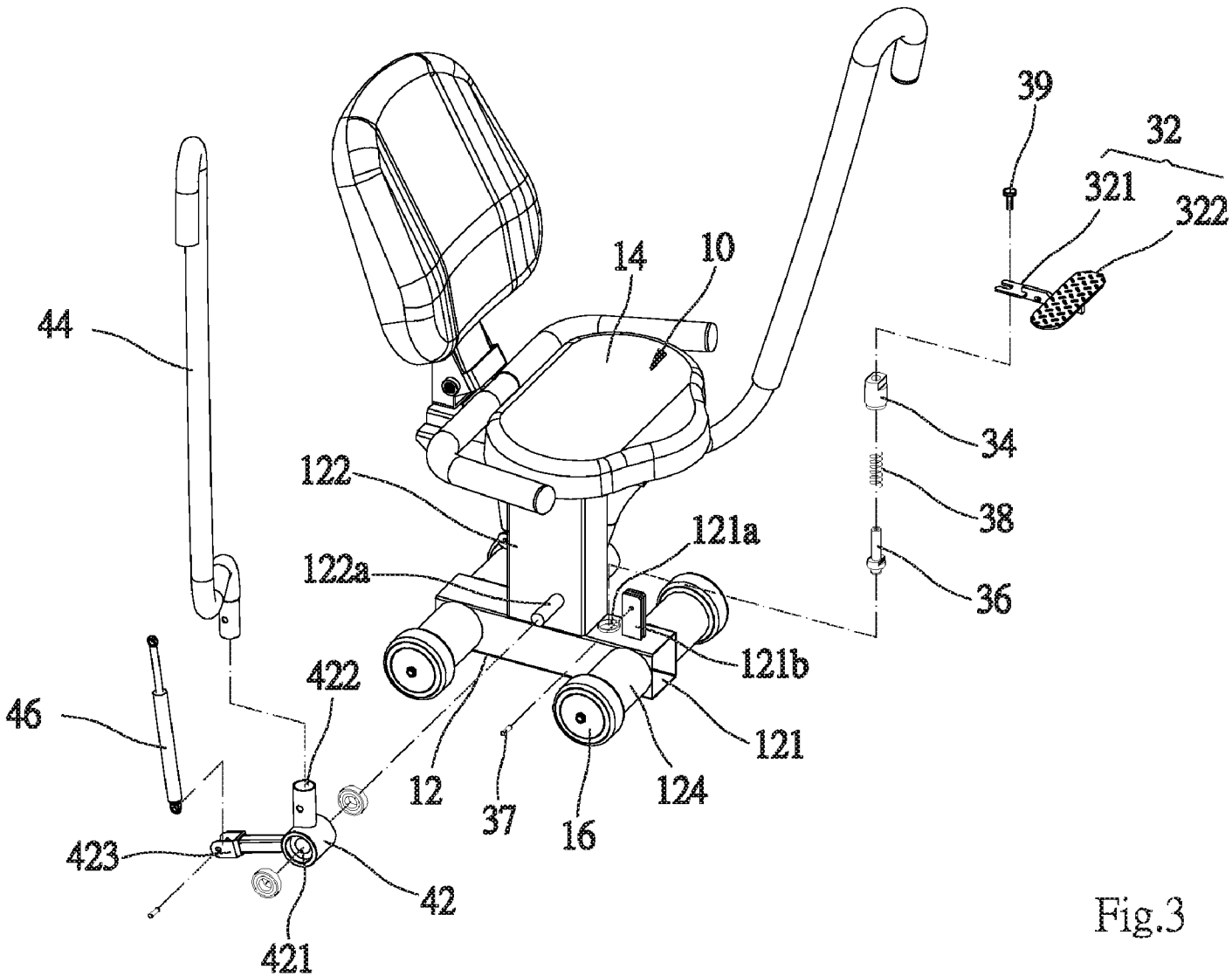
FIG. 3 is an exploded view of the seat assembly, the positioning device and the swinging mechanism the preferred embodiment of the present invention.
Figure 4:
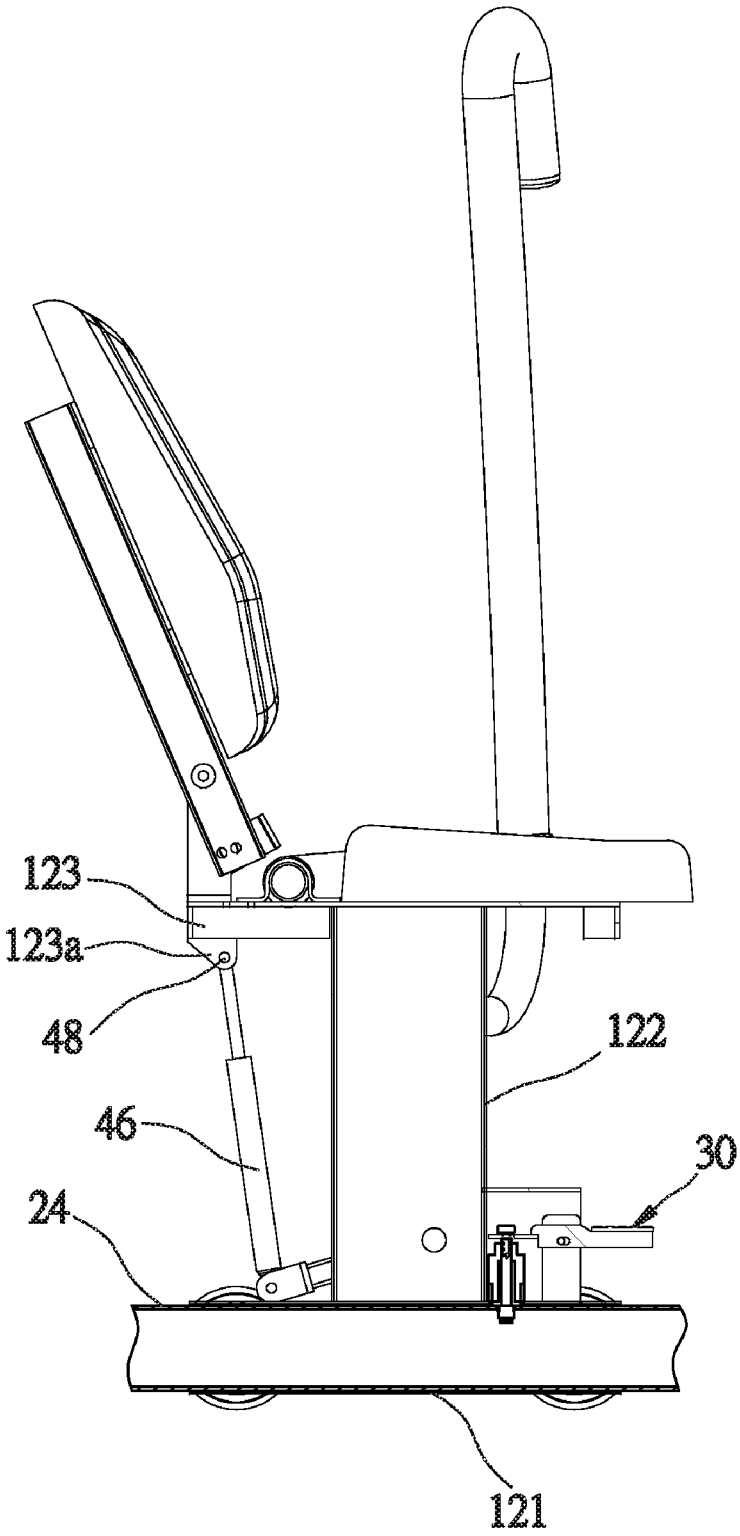
FIG. 4 is a sectional view of part of FIG. 3.

As shown in FIG. 3 and FIG. 4, the seat assembly 10 includes a base 12, a seat 14, and four rollers 16. The base 12 includes a main tube 121, a post 122, a frame 123, and two side tubes 124. The main tube 121, which is transverse and hollow, has an opening 121*a* and a pair of pivoting plates 121*b* beside the opening 121*a*. The post 122 is connected to the main tube 121 in a perpendicular direction. The seat 14 is fixed to a top end of the post 122. The post 122 has two pivoting shafts 122*a* at opposite sides adjacent to the main tube 121 to form a first pivoting portion. The frame 123 is at the top end of the post 122, extended in a reverse direction, and has a pair of pivoting plates 123*a* to form a second pivoting portion. The side tubes 124 are connected to opposite ends of the main tube 121 respectively. The rollers 16 are divided into two pairs and pivoted at ends of the side tubes 124 respectively.

Figure 7:
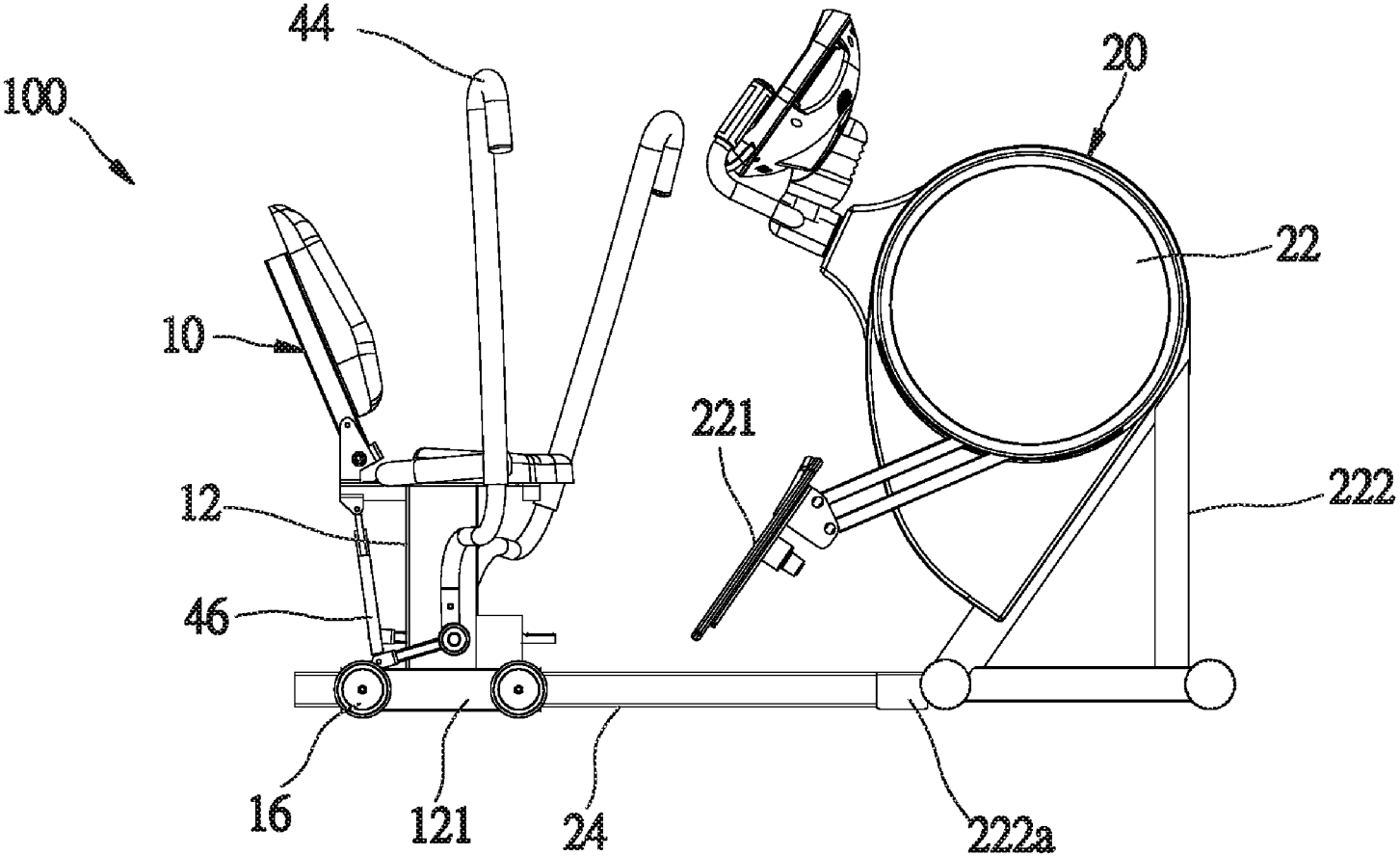
FIG. 7 is a lateral view of the preferred embodiment of the present invention.
Figure 8:
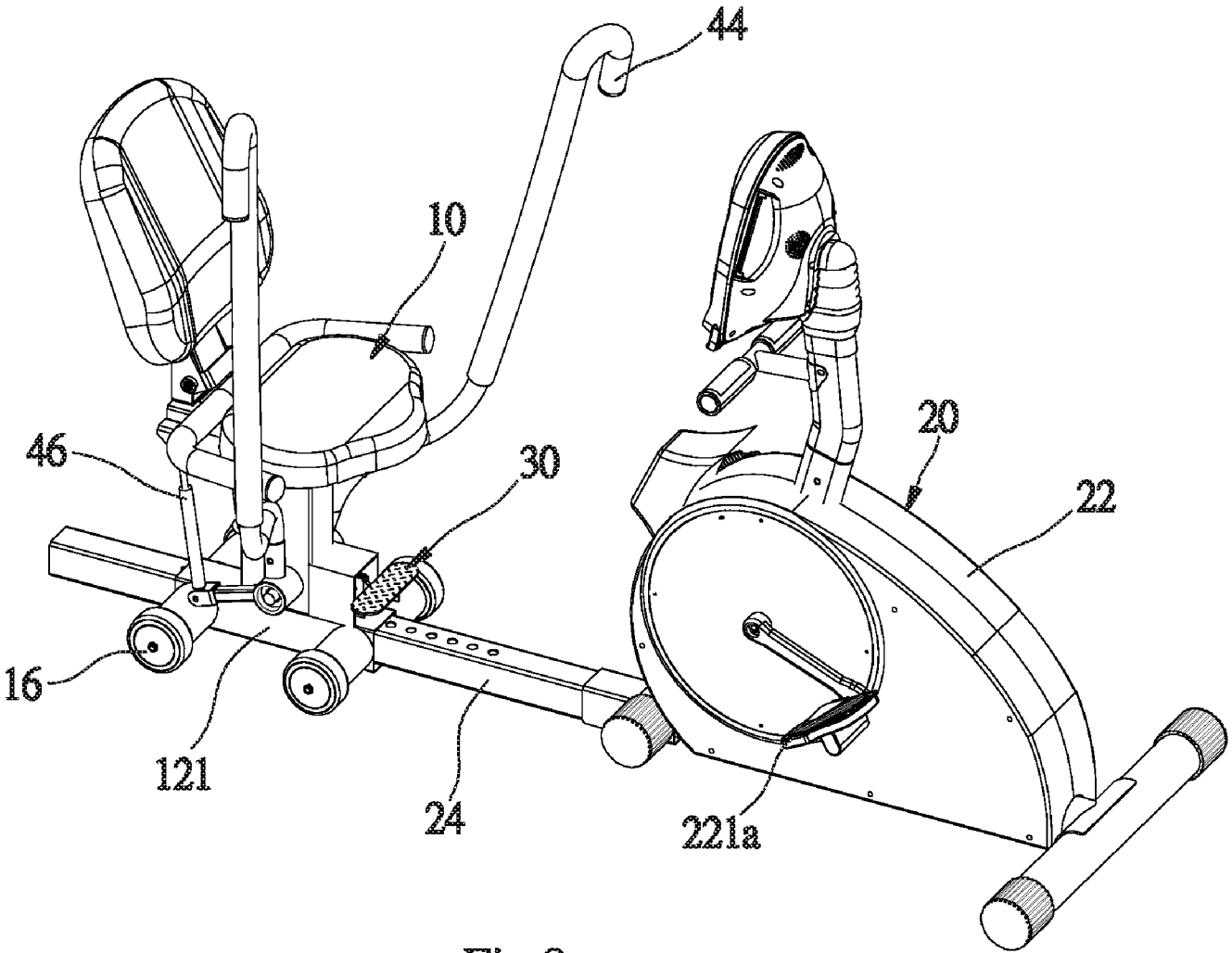
FIG. 8 is a perspective view of another preferred embodiment of the present invention.

The loading device 20 includes a loading provider 22 and an elongated rail 24. The loading provider 22 may be a damping mechanism as shown in FIG. 7 or a flywheel as shown in FIG. 8. Both types of the loading providers 22 have two pedals 221(221*a*) for users to step on. The pedals 221 are the input terminal of the loading provider 22. The loading provider 22 is the same as the conventional device, so we don't describe the details here.

As shown in FIG. 7, the loading provider 22 includes a frame 222, a tube 222*a* on the frame for engagement and disengagement with the rail 24. The rail 24 is fitted to the main tube 121 of the base 12 so that the seat assembly 10 is able to reciprocate. The rail 24 is provided with bores 241 in a row.

Figure 5:
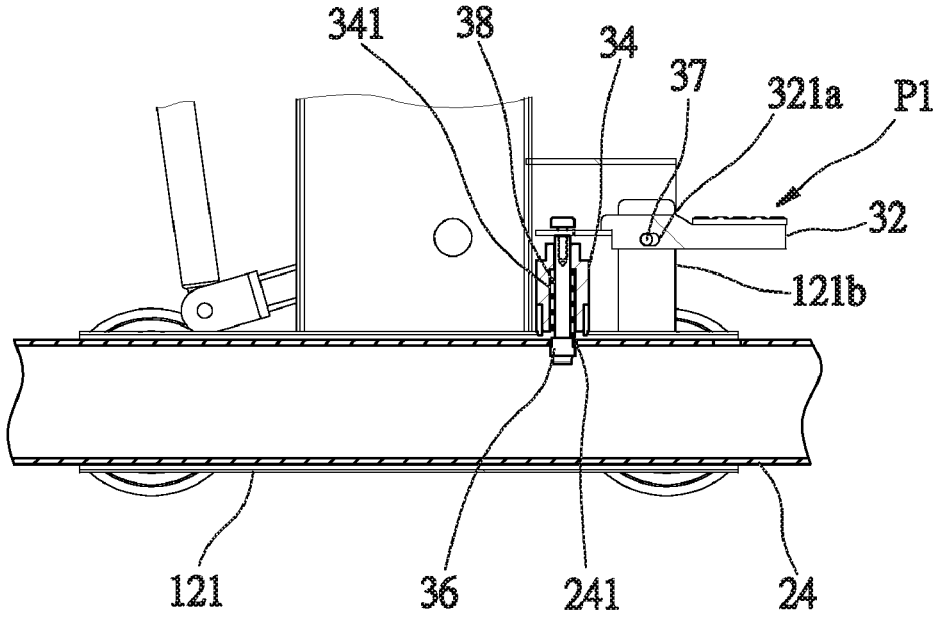
FIG. 5 is an enlarged view of FIG. 4, showing the board not pressed.

As shown in FIG. 3 and FIG. 5, the positioning device 30 includes a board 32, a barrel 34, a pin 36, and a spring 38. The board 32 has a first plate 321 and a second plate 322 connected together to form a T-shaped member. The first plate 321 has an elongated slot 321*a* for a pin 37 of the pivoting plates 121*b* of the base 12 to insert therein. The second plate 322 is to be operated by users, by means such as stepping by foot. The barrel 34 is fixed to the main tube 121 of the base 12. The barrel 34 has an opening aligned with the opening 121*a* of the main tube 121. The pin 36 and the spring 38 are received in the opening 341 of the barrel 34 that the pin 36 has an end left out of the barrel 34 and is fixed to the first plate 321 of the board by a nut 39. The spring 38 urges the pin 36 toward the rail 24. When the pin 36 is engaged with one of the bores 241 of the rail 24, the seat assembly 10 is stopped at the very place.

The swinging device 40 has two rotary members 42, two handles 44, and a damping unit, which has two cylinders 46. The rotary members 42 are two L-shaped shafts with an opening 421 at a turning portion respectively. The pivoting shafts 122*a* are inserted into the openings 421 of the rotary members 42 respectively that the rotary members 42 are pivoted on the opposite sides of the post 122. Each of the rotary members 42 has a fixing portion 422 and a pivoting portion 423 at opposite ends. The handles 44 are fixed to the fixing portions 422 of the rotary members 42, and the cylinders 46 are pivoted on the pivoting portions 423 of the rotary members 42 respectively. Pins 48 are inserted into the other end of the cylinders 46 and the pivoting plates 123*a* that the handles 44 may be swung by users and the cylinders 46 provide the handles 44 with resistance.

The elements and structures of the training machine 100 of the present invention are described as above, and the operation and functions will be described hereunder.

Figure 6:
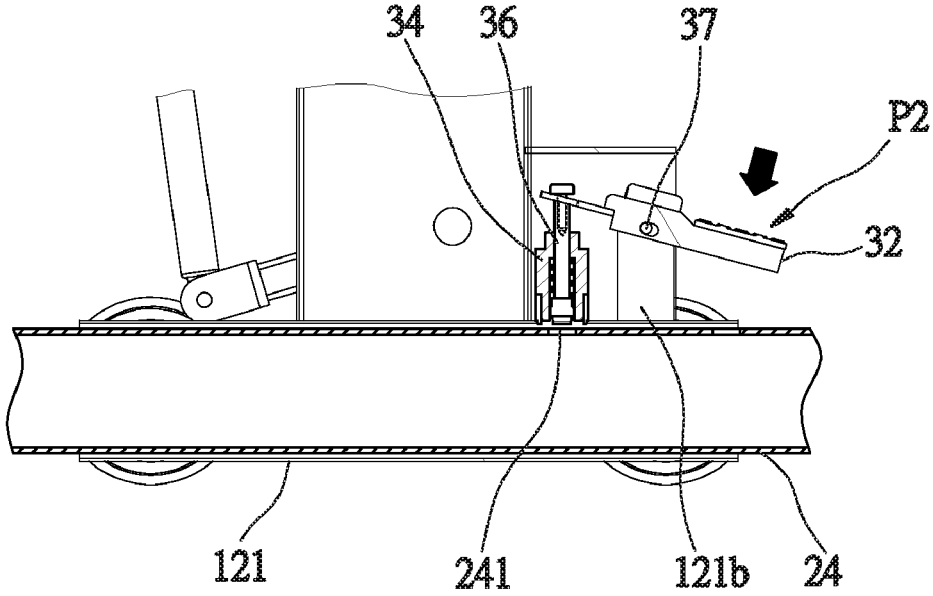
FIG. 6 follows FIG. 5, showing the board pressed.

As shown in FIG. 5, the board 32 is not pressed and located at a first position P1. Under this condition, the pin 36 is urged by the spring 38 to enter one of the bores 241 of the rail 24 that the seat assembly 10 is unable to move. Users may move the seat assembly 10 to any desired position by engaging the pin 36 with a specific bore 241. When users presses the board 32 to a second position P2, it will move the pin 36 upwards and disengage the bore 241, as shown in FIG. 6, that the seat assembly 10 is free to move along the rail 24. By having the main tube 121 of the base of the present invention with a sufficient length fitted to the rail 24 and the rollers 16 touching the ground, the present invention may allow the seat assembly 10 to adjust to any desired position in a smooth way, as shown in FIG. 7.

In addition, the rail 24 of the present invention is detachably fixed to the loading mechanism 22 that may reduce the volume when the training machine 100 is disassembled to lower the cost of packing and delivery.

The description above is a few preferred embodiments of the present invention and the equivalence of the present invention is still in the scope of the claim of the present invention.

What is claimed is:

1. A training machine, comprising:

a seat assembly including a base having a transverse main tube and a post connected to the main tube, a seat fixed to a top of the post, and a plurality of rollers positioned on opposite sides of the base respectively for rotation;

a loading device including an elongated rail connected to the main tube of the base for the seat assembly to reciprocate, and a loading mechanism provided at an end of the rail having an input terminal for operation; and a positioning device for fixing the seat assembly to the rail of the loading device;

wherein the rail of the loading device has a plurality of bores in a row, and the positioning device has a pin to be inserted into any of the bores, and the positioning device further has a barrel fixed to the base and receiving the pin therein, and a board pivoted on the base to be moved for engaging and disengaging the pin with the bore.

2. The training machine as defined in claim 1, wherein the positioning device further has a spring received in the barrel to urge the pin toward the rail.

3. The training machine as defined in claim 1, wherein the rail of the loading device is detachably connected to the loading mechanism.

4. A training machine, comprising:

a seat assembly including a base having a transverse main tube and a post connected to the main tube, a seat fixed to a top of the post, and a plurality of rollers positioned on opposite sides of the base respectively for rotation;

a loading device including an elongated rail connected to the main tube of the base for the seat assembly to reciprocate, and a loading mechanism provided at an end of the rail having an input terminal for operation;

a positioning device for fixing the seat assembly to the rail of the loading device; and a swinging device, which is provided on the seat assembly, including at least a handle pivoted on the base, and at least a damping unit to provide the handle with resistance when the handle is moved.

5. The training machine as defined in claim 4, wherein the base of the seat assembly has a first pivoting portion and a second pivoting portion, and the swinging device has at least a rotary member, which is pivoted on the first pivoting portion of the base, having a fixing portion fixed with the handle and a pivoting portion connected to the damping unit, which has a cylinder with an end pivoted on the pivoting portion of the rotary member and an opposite end pivoted on the second pivoting portion of the base.

* * * * *